United States Patent [19]

Ohkoshi et al.

[11] Patent Number: 4,710,765

[45] Date of Patent: Dec. 1, 1987

[54] LUMINESCENT DISPLAY DEVICE

[75] Inventors: Akio Ohkoshi, Tokyo; Koji Tsuruta, Kanagawa; Hideaki Nakagawa, Tokyo; Satoshi Shimada, Kanagawa, all of Japan

[73] Assignee: Sony Corporation, Tokyo, Japan

[21] Appl. No.: 635,608

[22] Filed: Jul. 30, 1984

[30] Foreign Application Priority Data

Jul. 30, 1983 [JP] Japan ..... 58-140141
Jul. 30, 1983 [JP] Japan ..... 58-140143

[51] Int. Cl.[4] ..... G09G 3/00
[52] U.S. Cl. ..... 340/781; 340/772
[58] Field of Search ..... 340/701, 720, 744, 781, 340/771, 772; 313/481, 495, 553

[56] References Cited

U.S. PATENT DOCUMENTS

| | | | |
|---|---|---|---|
| 2,964,672 | 12/1960 | Nixon | 340/720 |
| 3,140,473 | 7/1964 | Gaffney, Jr. | 340/744 |
| 3,407,331 | 10/1968 | Salgo | 340/701 |
| 3,935,499 | 1/1976 | Oess | 313/495 |
| 4,156,239 | 5/1979 | Hirano et al. | 313/496 |
| 4,166,233 | 8/1979 | Stanley | 340/701 |
| 4,218,636 | 8/1980 | Miyazawa | 340/701 |
| 4,608,518 | 8/1986 | Fukuda et al. | 313/495 |

*Primary Examiner*—Marshall M. Curtis
*Attorney, Agent, or Firm*—Hill, Van Santen, Steadman & Simpson

[57] ABSTRACT

A luminescent display cell comprising a glass envelope having a front panel, a side wall, and a rear plate. Plural luminescent display segments are formed on the front panel of the glass envelope, the display segments being supplied with an anode voltage. Plural cathodes are arranged on the rear panel side of the glass envelope in corresponding relation to the display segments. Plural control grid electrodes are arranged between the display segments and the cathodes in corresponding relation to the display segments. A common accelerating electrode is disposed between the display segments and the control grid electrodes. The voltage applied to each control grid electrode is controllable for electron emission from the cathodes so as to render each display segment corresponding to each control grid electrode selectively luminous for display. Furthermore, a separator surrounds each display segment and it is supplied with the above anode voltage so that diffusion lens is formed which allows the electron beam from the cathode to be spread laterally and radiated to the entire surface of the display segment to be rendered luminous.

11 Claims, 17 Drawing Figures

LUMINESCENT DISPLAY DEVICE

BACKGROUND OF THE INVENTION

The present invention relates to a highly luminescent display cell.

Attempts have been made to develop a large-sized display device in which a large number of luminescent display cells are arranged to obtain a large screen. In this case, it is desired that each luminescent cell be formed thin as a whole and that a stable luminescence at a high luminance be ensured.

Where plural display segments are disposed within a single luminescent display cell, it is necessary that a selected display segment be made fully luminous, while an unselected display segment be rendered non-luminous with a high degree of confidence.

For example, in a highly luminescent display cell having a plurality of luminescent display segments, a plurality of cathodes and control electrodes are disposed in corresponding relation to each segment. A common accelerating electrode is also provided. The display segments are rendered luminous selectively by controlling the voltage applied to the control electrodes. It is possible that when one display segment is made luminous, another display segment adjacent thereto will also be made luminous by secondary electrons. In such a display cell, moreover, in order to obtain a high luminance, it is desirable to construct the cell so that the electron beam impinges upon the entire surface of a phosphor layer of a display segment.

SUMMARY OF THE INVENTION

In view of the above-mentioned points, the present invention provides a novel luminescent display cell which is thin and ensures a stable luminescence at a high luminance which is capable of preventing with certainty an erroneous display caused by secondary electrons, and which allows the electron beam to impinge upon the entire surface of a selected display segment.

According to one aspect of the present invention, there is provided a luminescent display cell having a plurality of luminescent display segments to which is applied a high voltage, a plurality of cathodes and control electrodes (first grids) disposed in corresponding relation to each segment, and a common accelerating electrode (second grid) disposed between the display segments and the control electrodes. The voltage of each control electrode is controlled to render each segment selectively luminous.

According to another aspect of the present invention, there is provided a luminescent display cell having a plurality of luminescent display segments to which is applied a high voltage, a plurality of cathodes and control electrodes disposed in corresponding relation to each segment, a common accelerating electrode disposed between the display segments and the control electrodes, and a separator supplied with the above high voltage. The separator is disposed in surrounding relation to each segment.

Furthermore, with the invention a diffusion lens is formed permitting the electron beam to be radiated to the entire surface of a selected display segment.

DESCRIPTION OF THE PREFERRED EMBODIMENTS

Embodiments of the present invention will be described in detail hereafter with reference to the drawings.

Figure 1:
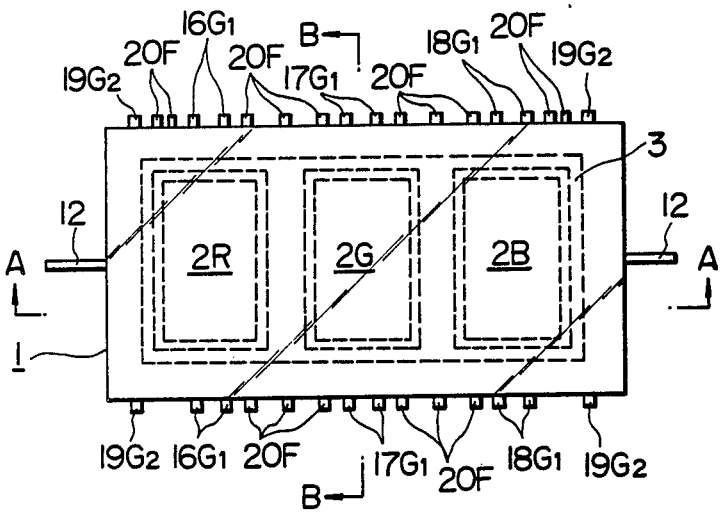
FIG. 1 is a front view of a luminescent display cell embodying the present invention.
Figure 2:
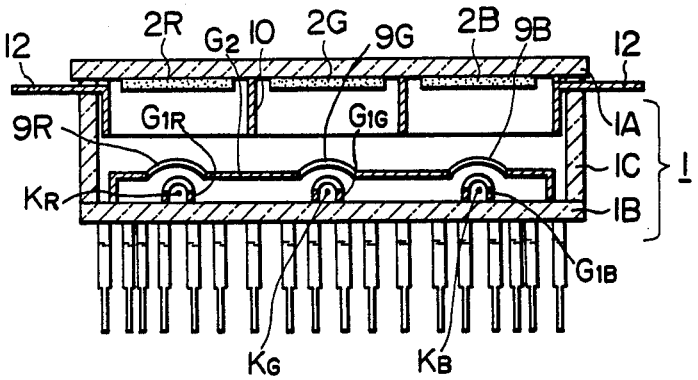
FIG. 2 is a sectional view taken on line A—A of FIG. 1.
Figure 3:
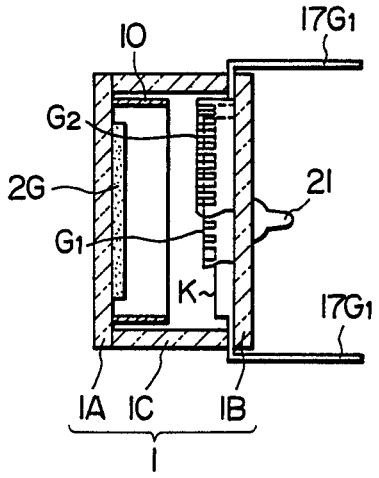
FIG. 3 is a sectional view taken on line B—B of FIG. 1.
Figure 5:
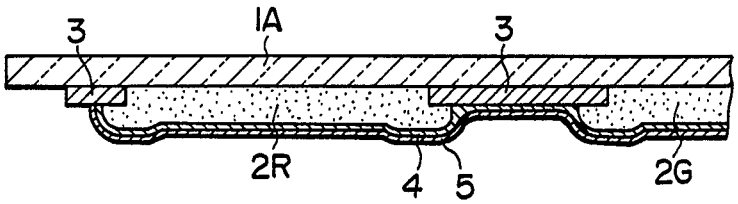
FIG. 5 is an enlarged sectional view of a display segment.
Figure 4:
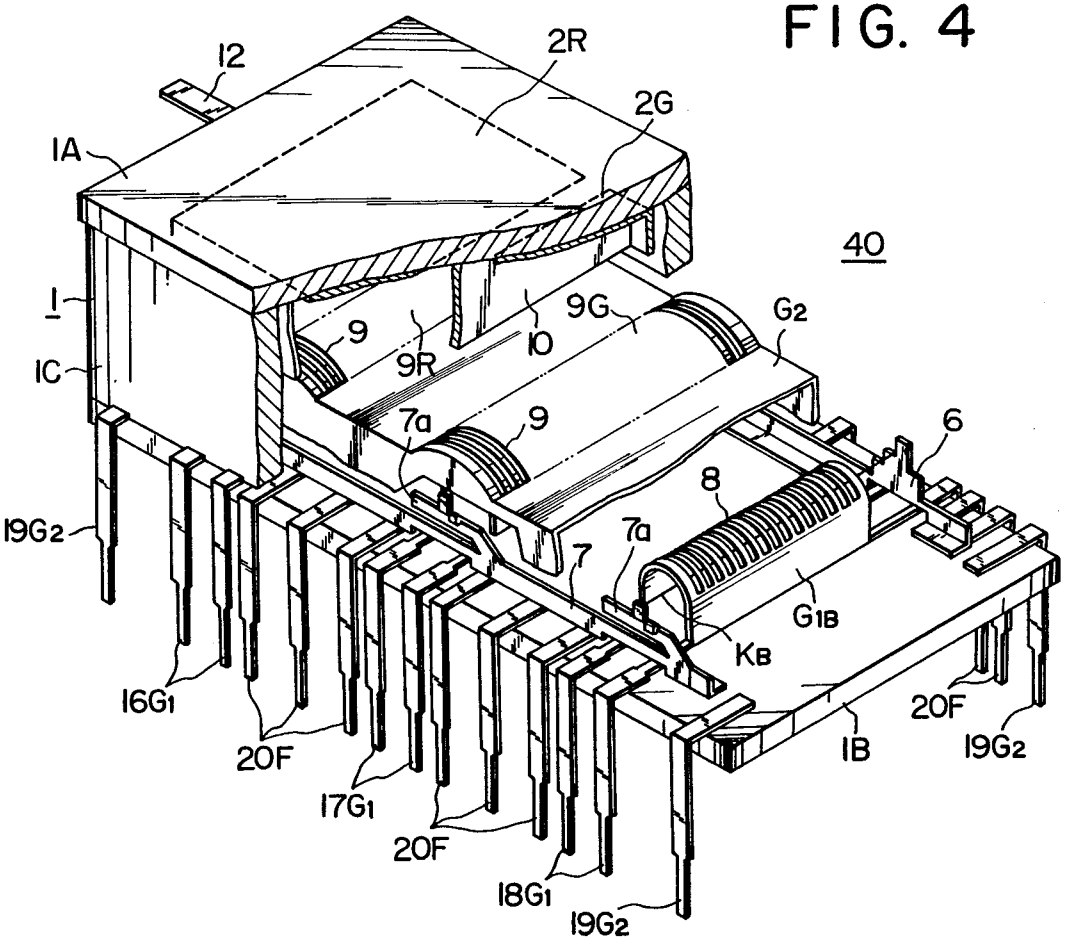
FIG. 4 is a partially cut-away perspective view.
Figure 6:
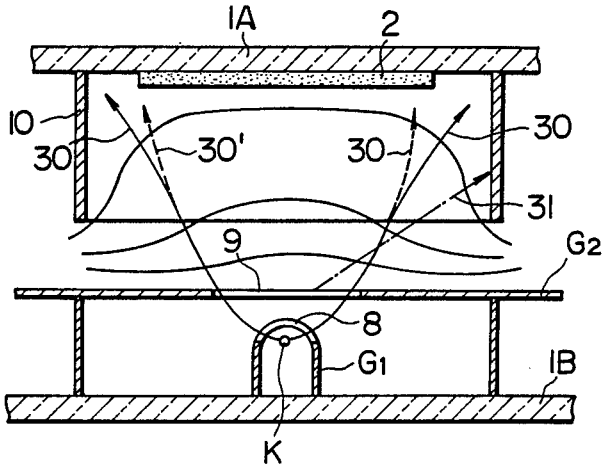
FIG. 6 is a sectional view illustrative of operation of a separator.

Referring to FIGS. 1 to 4, which are a front view of a luminescent display cell embodying the invention, a sectional view taken on line A—A thereof, a sectional view taken on line B—B thereof, and a partially cut-away perspective view of the cell, the reference numeral 1 denotes a glass envelope comprising a front panel 1A, a rear plate 1B and a side wall 1C. Within the glass envelope 1 are disposed a plurality of luminescent display segments 2 (2R, 2G, 2B), a plurality of cathodes K ($K_R$, $K_G$, $K_B$) and first grids $G_1$ ($G_{1R}$, $G_{1G}$, $G_{1B}$) in corresponding relation to each display segment, and a common second grid (accelerating electrode) $G_2$. The display segments 2 each comprise a phosphor layer formed on the inner surface of the front panel 1A. There are formed three display segments 2R, 2G, and 2B for the luminescence of red, green and blue, respectively. More particularly, as shown in FIG. 5, a carbon layer 3 as a conductive layer is printed in the form of a frame on the inner surface of the front panel. In spaces in the frame, red, green and blue phosphor layers 2R, 2G and 2B are formed by printing as display segments so as to partially overlap the carbon layer 3. Throughout the surfaces of these phosphor layers a metal back layer 5 is formed, e.g. an aluminum layer, through a filming layer 4. Furthermore, in opposed relation to the display segments 2R, 2G and 2B comprising the above phosphor layers and inside the rear panel 1B wire cathodes KR, KG and KB are positioned, first grids $G_{1R}$, $G_{1G}$ and $G_{1B}$ opposite these wire cathodes, and the second grid $G_2$ in common to the three first grids $G_{1R}$, $G_{1G}$ and $G_{1B}$. Each wire cathode K is formed, for example, by coating the surface of a tungsten heater with carbonate as an electron emissive material. The wire cathodes $K_R$, $K_G$ and $K_B$ are each stretched between a pair of conductive support members 6 and 7 which are disposed on both side portions of the rear panel 1B. One support member 6 is for fixing one end of each wire cathode, while the other supporr member 7 is provided with a spring portion 7a to which is fixed the other end of each wire cathode. According to this arrangement, an even extension of the wire cathode due to a rise of the temperature would be absorbed by the spring portion 7a, and thus the wire cathode never becomes loose. The first grids $G_{1R}$, $G_{1G}$ and $G_{1B}$ are formed in a half-cylindrical shape having a cylindrical surface in corresponding relation to the wire cathodes and a plurality of slits 8 are formed in the cylindrical surface at a predetermined pitch along the longitudinal direction of the same surface. The slits 8 are for the transmission therethrough of electrons radiated from the wire cathode K. The second grid $G_2$ is formed with slits 9 in portions corresponding to the first grids $G_{1R}$, $G_{1G}$ and $G_{1B}$ and in positions corresponding to the slits 8 of the first grids. In this case, slit portions 9R, 9G and 9B of the second grid $G_2$ may be formed so as to have cylindrical surfaces concentric with the corresponding first grids $G_{1R}$, $G_{1G}$ and $G_{1B}$. In this construction, electron beams from the wire cathodes are radiated rectilinearly through the slits 8 and 9 of the first and second grids and are spread with respect to the longitudinal direction of the slits. On the other hand, the portions of the second grid in which are formed the slits 9 may be horizontal as shown in FIG. 6. In this case, the electron beam is radiated so that it passes through the second grid and then is curved somewhat inwardly with respect to the longitudinal direction of the slits, as shown in dotted line 30'.

Figure 9:
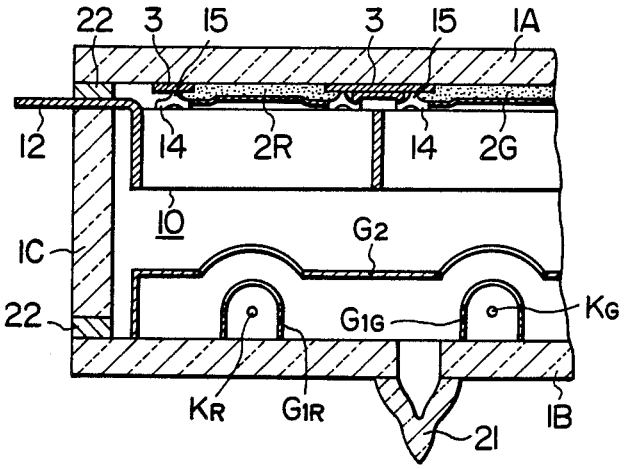
FIG. 9 is a sectional view of display segments and a separator portion.
Figure 7:
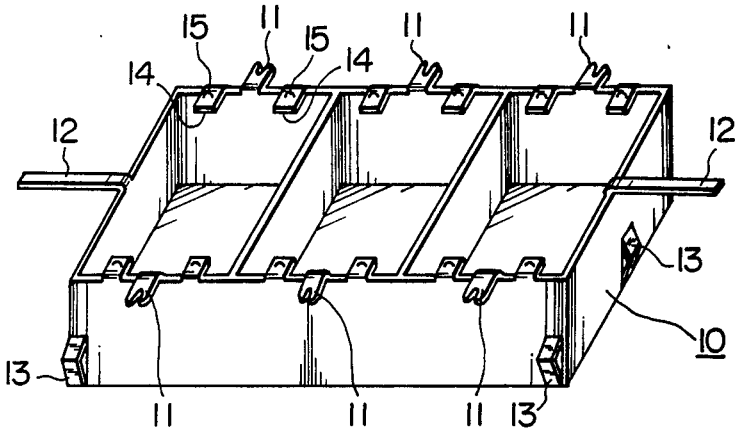
FIG. 7 is a perspective view of the separator.
Figure 8:
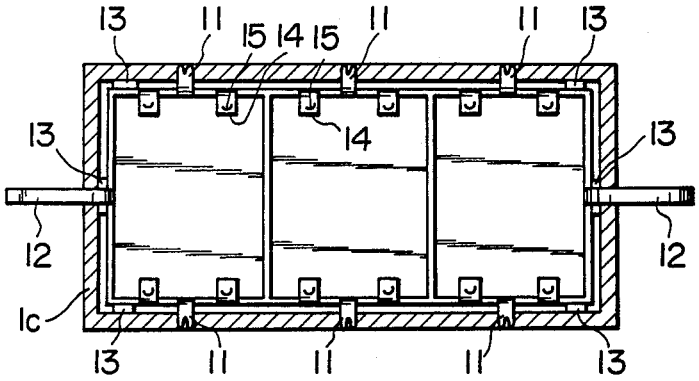
FIG. 8 is a plan view in which the separator is disposed within a side of an envelope.

On the other hand, a separator 10 formed of a conductive material is disposed to surround the display segments 2R, 2G and 2B. The separator 10 not only serves as a shield for preventing a secondary electron 31 (see FIG. 6) induced by impingement of electron beam from cathode against the first or second grid $G_1$ or $G_2$ from rendering an adjacent display segment luminous, but also serves to form a diffusion lens which functions to spread electron beam 30 from each wire cathode K so that the electron beam is radiated throughout the corresponding display segment 2. In addition, the separator 10 is used also as power supply means for supplying a high voltage, e.g. 10 KV, to each display segment. In assembling, the separator 10 is supported between the front panel 1A and side wall 1C of the glass envelope 1 and fixed by frit. More specitically, as shown in FIG. 7, the separator 10 is in the form of a frame partitioned in threes to surround the display segments, and on first opposed upper ends thereof are formed outwardly projecting supporting pieces 11, while on the other opposed upper ends are formed anode leads 12 for the supply of high voltage (anode voltage). Furthermore, on the side portions of the separator 10 are formed outwardly bent elastic positioning pieces 13. When the separator 10 is inserted from above in the inner wall 1C, as shown in FIG. 8, the supporting pieces 11 abut the upper end face of the side wall 1C to thereby support the separator, and at the same time the bent portions 13 abut the inner surface of the side wall 1C to thereby position the separator in central fashion. Also provided on the upper end portion of the separator 10 are inwardly bent lugs 14 each having a projection formed on the surface thereof. When the front panel 1A is placed and sealed on the side wall 1C after enclosing the separator 10 in the side wall, the projections 15 contact the carbon layer 3 or the metal back layer 5 (see FIG. 9). As a result, the high voltage from the anode leads 12 is fed in common to the display segments 2R, 2G and 2B. In an assembled state, the anode leads 12 to which is applied the high voltage are drawn out to the exterior through the sealed portion between the front panel 1A and the upper end face of the side wall 1C, while the leads of the wire cathodes K, first grid $G_1$, and second grid $G_2$ are drawn out to the exterior through a sealed portion between the rear plate 1B and the side wall 1C. The leads of the cathodes K, first grids $G_1$, and second grid $G_2$ are brought out together for supporting purposes. For example, in each of the first grids $G_{1R}$, $G_{1G}$ and $G_{1B}$, two leads on each side, namely, a total of four leads on both sides, are brought out as leads 16$G_1$, 17$G_1$, and 18$G_1$. In the case of the second grid $G_2$, four leads 19$G_2$ are brought out corresponding to the four corners of the rear panel. Leads 20F of the cathodes K are brought out together to the right and left from both support members 6 and 7. The leads 20F of the cathodes are connected in common for each of the support members 6 and 7. Also with respect to each of the first and second grids $G_1$ and $G_2$, the corresponding leads are connected in common.

The glass envelope 1 is provided by sealing the front panel 1A, side wall 1C and rear plate 1B with respect to each other by frits 22. To the rear plate 1B is a chip-off pipe 21 for gas exhaust fixed by frits.

Operation of the above construction will now be explained. An anode voltage of, say, 10 kV or so is supplied through the anode leads 12 to the red, green and blue display segments 2R, 2G and 2B. To each of the first grids $G_{1R}$, $G_{1G}$ and $G_{1B}$ is applied a voltage of, say, 0–10V, while to the second grid $G_2$ is applied a voltage of, say, 30–50V. The wire cathodes $K_R$, $K_G$ and $K_B$ are of 80–120 mW or so per wire. In this construction, the anode side and the second grid $G_2$ are fixed in voltage, while the voltage applied to the first grids $G_1$ is changed to turn on and off the display segments selectively. More particularly, when OV is applied to a first grid $G_1$, an electron beam from cathode K is cut off and the corresponding display segment 2 is not rendered luminous. When, say, 5V is applied to a first grid G, an electron beam from cathode K passes through the first grid $G_1$, then is accelerated by the second grid $G_2$ and impinges upon the phosphor of the corresponding display segment 2 to make the latter luminous. At this time, the luminance is controlled by controlling the pulse width (duration) of the voltage (5V) applied to the first grid $G_1$. Further, as shown in FIG. 6, the electron beam from cathode K is spread by the separator 10 and radiated to the entire surface of the display segment 2. When the electron beam from the cathode impinges upon the first and second grids, there are produced the secondary electrons 31 from these grids, but these secondary electrons are obstructed by the separator 10, so they do not impinge upon the adjacent display segment 2. In this way, by selectively controlling the voltage applied to the first grids, the display segments 2R, 2G and 2B are rendered luminous selectively at a high luminance.

This luminescent display cell 40 is constructed in thin fashion as a whole. Besides, the low voltage-side leads such as the cathode and first and second grid leads are drawn out from the rear plate 1B side of the glass envelope 1, while the high voltage-side anode leads 12 are drawn out from the front panel 1A side. Therefore, possible dangers during discharge and wiring can be avoided, thus ensuring a stable luminescent display.

Moreover, since the anode voltage-applied separator 10 surrounds each display segment 2, a diffusion lens is formed by the separator 10. Therefore, even if only the first grids $G_1$ are curved and the second grid $G_2$ is flat (as shown in FIG. 6), the electron beam from cathode K spreads laterally (in the direction of the slits) and is radiated to the entire surface of the display segment 2. At the same time, the secondary electron from the first or second grid is obstructed by the separator 10, so the adjacent cut-off segment is not rendered luminous.

In the case of a color display (for example, in the case of a 9300° K white screen), the luminance mixing ratio is about 7% blue, about 13% red, and about 80% green. In the case where wire cathodes are used as an electron emission source, they are in many cases used in a temperature restriction area in order to maintain their service life. And the problem of making the luminance of the green cathode higher than that of the other cathodes can be solved by increasing the number used. For example two green cathodes $K_G$, one red cathode $K_R$, and one blue cathode $K_B$ may be used. As a result, the total amount of electrons for green becomes larger than that for red and blue, thus making it possible to effect a color display. It goes without saying that red and blue cathodes may also be used in plural numbers, which is effective in prolonging their service life. Thus, by increasing the number of green cathodes in comparison with the other cathodes, the luminance can be enhanced and a good white balance is obtainable. Consequently, an excessive load is not imposed on the cathodes, that is, the life of the luminescent display cell can be prolonged. Actually, two green cathodes are disposed in spaced relation at a distance of about 0.8 to 1 mm. As to the amount of electrons emitted, an increase of 70 to 80% can be expected though it does not become twice as large as that in the case of a single green cathode due to the electron scattering effect. Alternatively, the green luminance may be enhanced by making the area of the green phosphor layer larger than of the red and blue phosphor layers.

Figure 10:
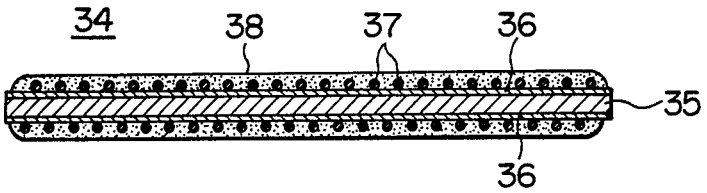
FIG. 10 is a sectional view showing another example of a wire cathode.
Figure 11:
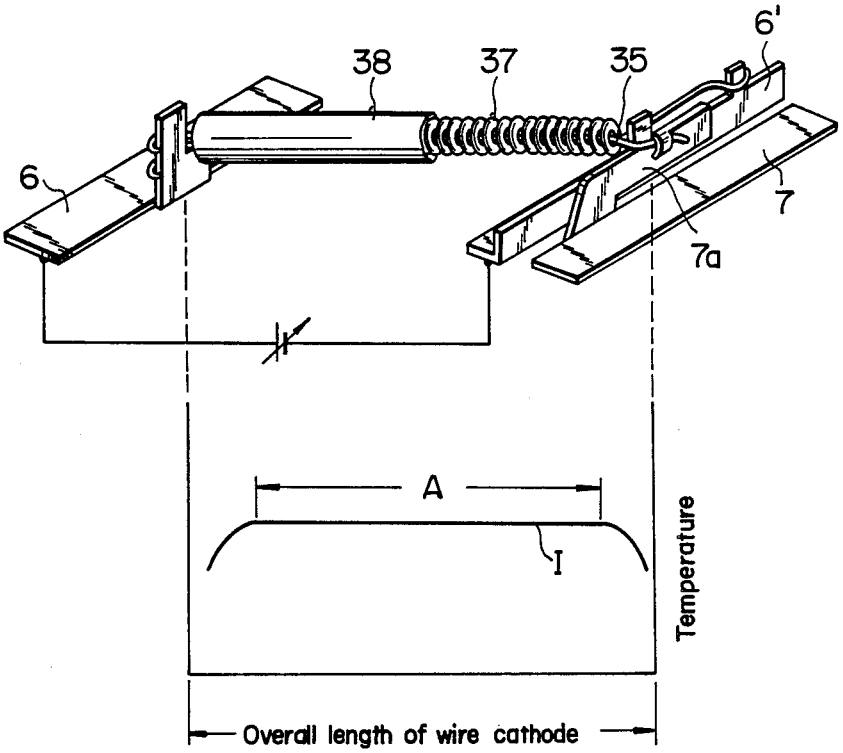
FIG. 11 is a perspective view showing a mounted state thereof.
Figure 12:
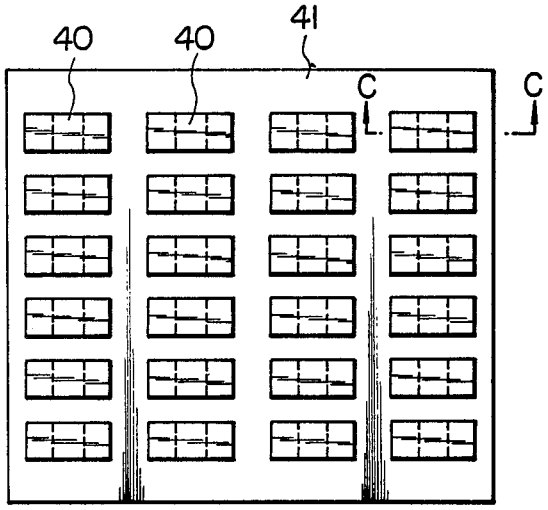
FIG. 12 is a front view of a single unit incorporating plural display cells.

Since the wire cathodes are used in the temperature restriction area, that is, the loadingof the oxide cathode is set at a ratio of one to several tens to prevent a red-looking appearance, the amount of electrons emitted per cathode is small. One method for solving this problem may be to substantially enlarge the surface area of oxide by winding a tungsten wire spirally, for example. But, in the case of a long spiral, it is likely that there will occur loosening or vibration of the cathode. In view of this point, such a construction as shown in FIGS. 10 and 11 is suggested.

In this example, a core 35 formed of a high-temperature material such as, for example, tungsten or molybdenum, is provided and its surface is coated with an insulating material such as $Al_2O_3$. Then tungsten wire 37 serving as a heater is wound spirally thereon and an electron emissive material 38, e.g. carbonate, is bonded to the spiral portion by spraying or electrodeposition to constitute a direct heating cathode 34. The core 35 is fixed at one end thereof to one support member 6 and at the other end thereof to the spring portion *7a* of the other support member 7 by spot welding or other suitable means, it being stretched under tension. The tungsten wire is fixed between one support member 6 and a second support member 6' on the other side by spot welding or other suitable means.

Thus, in the above construction, the cathode is wound spirally onto the core 35 coated with the insulating material 36, and the core 35 is stretched by the spring portion, whereby problems such as shorting between spiral portions and thermal deformation of the spiral can be eliminated. Besides, the oxide surface area is substantially increased, and a uniform temperature distribution area (A) with reduced temperature difference between both ends and the center of the cathode becomes wider. As a result, the amount of electrons emitted can be increased, and as a whole, therefore, it is possible to increase the amount of allowable current per cathode. The curve I in FIG. 11 represents a temperature distribution.

Figure 13A:
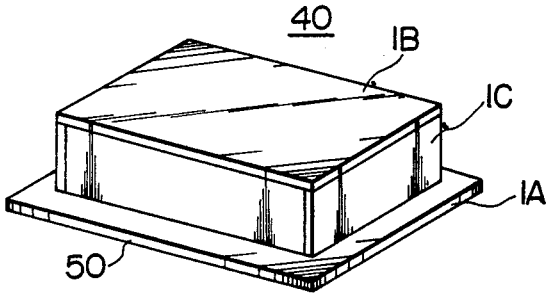
FIGS. 13A and 13B are perspective views showing other examples of display cells.
Figure 13B:
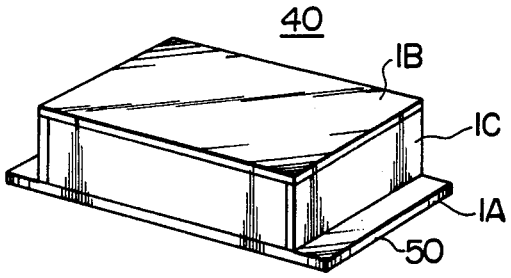
Figure 14:
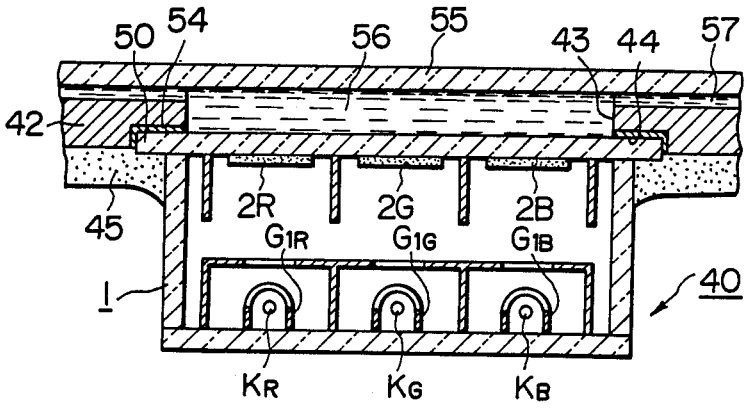
FIG. 14 is a sectional view taken on line C—C of FIG. 12.
Figure 15:
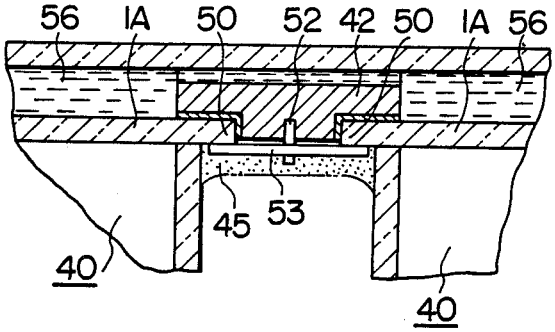
FIG. 15 is a sectional view showing another mounting method.
Figure 16:
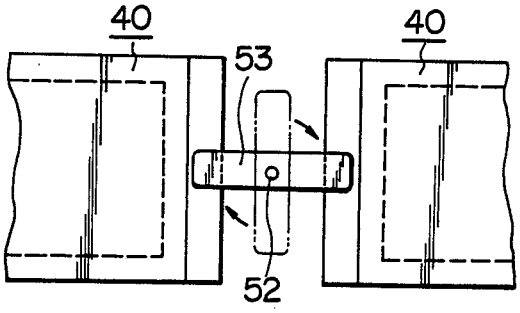
FIG. 16 is a rear view thereof.

The display cell 40 described above is incorporated in plural numbers, say, 24 in a unit case 41 to constitute one unit. Further, by arranging a large number of such units, a jumbo-size picture display device is provided. In mounting such plural display cells to the unit case, the cells are fixed to the case by molding with resin or the like. However, the anode voltage of the display cell is as high as about 10 kV, so if the fixing is incomplete, the display cell may become separated upon application of power from the surface, or the application of a liquid for removing stain or the like on the surface side. A change in conditions may also cause such trouble. Therefore, it is necessary to fix the display cells firmly to the unit case. For this purpose, each display cell 40 is formed so that the front panel 1A of the glass envelope 1 overhangs outwardly beyond the side wall 1C. In this case, the front panel 1A may overhang throughout the circumference as shown in FIG. 13A, or it may overhand only in one direction as shown in FIG. 13B. On the other hand, the unit case 41 is constructed as shown in FIG. 14, that is, plural (24 in the illustrated embodiment) window holes 43 are formed in a front plate 42 of the unit case 41 in opposed relation to the display cells 40, and a stepped portion 44 in which is to be fitted the marginal portion of the front panel 1A of each display cell is formed in the back of the marginal portion of each window hole 43. The display cell 40 is fitted in the back of the front plate 42 so that its front panel 1A faces the window hole 43, and then is fixed from the back by the use of a fixing member 45 such as a resin mold or the like. In this case, since the front panel 1A overhangs outwardly as an overhang portion 50, this overhang portion is held between the fixing member 45 and the front plate 42 of the unit case, and thus, as a whole, the display cell 40 is fixed firmly to the unit case 41. If necessary, as shown in FIGS. 15 and 16, there may be provided a retaining piece 53 which is rotatable about a shaft 52 to hold the overhang portion 50 of the front panel 1A of each display cell between it and the front plate 42 of the unit case. Subsequent fixing with resin mold or the like will further ensure the fixing of the display cell. Since the display cell is of a high luminance, the front panel side with phosphor layers applied thereto is apt to become high in temperature, so it is necessary to cool it, for example, with liquid. For this purpose, at the time of mounting each display cell to the unit case, a packing 54, e.g. silicone rubber, is interposed between the stepped portion 44 of the front plate 42 of the unit case and the front panel 1A, and a transparent plate 55 formed of polycarbonate or other material is disposed thereabove, and the space formed by the transparent plate 55, the front panel IA and the window hole 43 of the unit case is filled with a cooling liquid 56. In this case, the front plate 42 of the unit case is formed with cooling liquid introducing slots 57 communicating with the window holes 43.

Although the display cell having three luminescent display segments of red, green, and blue has been described above, the present invention is applicable also to a display cell in which plural luminescent display segments are arranged in the form of a pattern representing a character, numeral, or the like. For example, plural luminescent display segments are arranged in the form of an 8 and a common anode potential is applied thereto. Furthermore, plural cathodes and plural first grids are arranged in opposed relation to the display segments, and a common second grid is disposed between the first grids and the display segments. A desired display segment is rendered luminous selectively by controlling the voltage applied to the first grids.

According to the present invention described hereinabove, a highly luminescent display cell can be obtained easily, and in this case both a stable operation and a thin construction as a whole are attainable. Therefore, a very large display device can be easily provided by arranging a plurality of such display cells.

Moreover, since the separator supplied with the same high voltage as that applied to the display segments is positioned to surround the plural display segments, a diffusion lens is formed whereby an electron beam from the cathode is spread laterally and radiated to the entire surface of each display segment. Consequently, it is possible to make a display at a high luminance. Furthermore, by the presence of the separator, secondary electrons from a control electrode or accelerating electrode are obstructed, not rendering the adjacent cut-off display segment luminous, and thus a stable luminescent display can be effected.

Although various minor changes and modifications might be proposed by those skilled in the art, it will be understood that we wish to include within the claims of the patent warranted hereon all such changes and modifications as reasonably come within our contribution to the art.

We claim as our invention:

1. A luminescent display device, comprising:
- a glass envelope having front panel, side wall and rear plate;
- a plurality of luminescent segments formed on an inner surface of the front panel with a conductive layer coated thereon and positioned to form red, green, and blue displays in a line;
- a separator electrode formed of partitions extending from said front panel inner surface towards said rear plate and forming a frame around each segment;
- a respective cathode adjacent to the rear panel for each of the luminescent segments;
- a respective control grid electrode arranged between a respective segment and a respective cathode for each respective cathode and segment;
- a common accelerating electrode arranged between said segments and said control grid electrodes; and
- the control grid electrodes, common accelerating electrode, luminescent segment, and cathodes being positioned and dimensioned such that with an anode voltage applied to the separator electrode and said segments, a voltage applied to the accelerating electrode, and a voltage selectively applied to one or more of said control grid electrodes, electron emission from the respective cathodes is controlled so that the respective segment is selectively luminescent for display.

2. A device according to claim 1 in which a part of said separator electrode is placed at and supported by said front panel and said side wall, and respective parts of said cathodes, control grid electrodes, and accelerating electrode are placed at and supported by said rear plate and said side wall.

3. A device according to claim 1 in which said separator electrode is electrically connected to said segments.

4. A device according to claim 1 in which each segment is surrounded and framed by a black conductive pattern.

5. A device according to claim 1 in which said front panel, said side wall, and said rear plate are sealed and fixed to each other by frits to form said glass envelope.

6. A device according to claim 1 in which each cathode comprises a wire heater and an electron emissive material coated thereon.

7. A device according to claim 6 in which each cathode corresponding to each segment comprises at least one wire-like cathode.

8. A luminescent display device, comprising:
- an envelope having a front glass panel and rear plate;
- a plurality of luminous segments formed at the front panel;
- a respective cathode corresponding to each segment adjacent to the rear panel;
- a respective control grid electrode for each respective cathode and luminescent segment arranged between a respective luminescent segment and respective cathode;
- a common accelerating electrode between the luminescent segments and the control grid electrodes;
- a conductive separator means in a space between the common accelerating electrode and luminescent segments and which frames and is in electrical connection with each of the luminescent segments in a pattern of partitions which extend away from an inner surface of said front panel; and
- means for applying an anode voltage to said separator means, and respective voltages to said accelerating electrode, grid electrodes, and cathodes.

9. A luminescent display device according to claim 8 wherein conductive means are provided such that the respective voltage applied to the separator means is conducted to the luminescent segments.

10. A luminescent display device according to claim 8 wherein the control grid electrodes have an approximately half-cylindrical shape with slits in a cylindrical surface thereof and wherein the accelerator electrode has openings compatible with the control grid electrode slits such that when voltage is applied to the separator means, accelerator electrode, and control grid electrode, and wherein a heater voltage is applied to the respective cathode, an electron flow occurs from the cathode to the corresponding luminescent segment, said separator element restricting the second electron emission to other adjacent luminescent segments and also acting as a diffusion lens permitting the electron beam passing through the slits to be radiated to an entire surface of the selected luminscent segment.

11. A luminscent display device, comprising:
- an envelope having a glass front panel;
- a plurality of luminscent segments formed on the front panel;
- a separator electrode formed as a pattern comprised of partitions extending away from an inner surface of said front panel such that each segment is laterally framed by and isolated from adjacent segments by the partitions of the separator electrode;

means for connecting an anode voltage to the separator electrode;

an accelerator electrode common to a plurality of the luminescent segments adjacent to the separator electrode;

a control grid electrode associated with each segment having a tunnel shape and with apertures therein;

a wire cathode running through each control grid electrode; and means for applying respective voltages to said accelerator electrode, control grid electrodes, and cathodes.

* * * * *